US009637260B2

(12) United States Patent
Ghirardello et al.

(10) Patent No.: US 9,637,260 B2
(45) Date of Patent: May 2, 2017

(54) PACKAGING MACHINE AND METHOD FOR PRODUCING SEALED PACKAGES OF A FOOD PRODUCT FROM A WEB OF A PACKAGING MATERIAL

(75) Inventors: Roberto Ghirardello, Carpi (IT); Danilo Veroni, Rubiera (IT); Massimo Melotti, Modena (IT); Cesare Bertacchini, Soliera (IT); Alessandro Veronesi, Limidi di Soliera (IT); Simone Maini, Carpi (IT); Renzo Bellei, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/238,387

(22) PCT Filed: Aug. 29, 2012

(86) PCT No.: PCT/EP2012/066766
§ 371 (c)(1),
(2), (4) Date: Feb. 11, 2014

(87) PCT Pub. No.: WO2013/050203
PCT Pub. Date: Apr. 11, 2013

(65) Prior Publication Data

US 2014/0196407 A1 Jul. 17, 2014

(30) Foreign Application Priority Data

Oct. 3, 2011 (EP) ..... 11183735

(51) Int. Cl.
*B65B 55/04* (2006.01)
*B67B 1/03* (2006.01)
(Continued)

(52) U.S. Cl.
CPC ..... *B65B 55/027* (2013.01); *B65B 9/20* (2013.01); *B65B 43/10* (2013.01); *B65B 51/30* (2013.01); *B65B 55/103* (2013.01)

(58) Field of Classification Search
CPC ..... B65B 55/103; B65B 55/08; B65B 1/02; B65B 43/08; B65B 55/04; B65B 55/027;
(Continued)

(56) References Cited

U.S. PATENT DOCUMENTS 3,643,586 A * 2/1972 Robinson ..... 53/510
3,854,874 A * 12/1974 Loliger ..... B65B 55/103 118/65
(Continued)

FOREIGN PATENT DOCUMENTS

EP 1 155 962 A1 11/2001
EP 1 795 448 A1 6/2007
(Continued)

OTHER PUBLICATIONS

International Search Report (PCT/ISA/210) mailed on Nov. 14, 2012, by the European Patent Office as the International Searching Authority for International Application No. PCT/EP2012/066766.
(Continued)

*Primary Examiner* — Robert Long
(74) *Attorney, Agent, or Firm* — Buchanan Ingersoll & Rooney PC

(57) ABSTRACT

There is described a packaging machine for producing sealed packages of pourable food products from a web of packaging material, comprising: an aseptic chamber through which web is fed and within which a sterilizing agent is applied onto web; a station which is arranged downstream from said aseptic chamber and in which a tube formed by web is, in use, fed; and a sealing device which separate chamber and station; packaging machine also comprise a
(Continued)

conveyor fluidically connected with station and adapted to convey away residues of sterilizing agent from station.

11 Claims, 3 Drawing Sheets

(51) Int. Cl.
*B65B 55/02* (2006.01)
*B65B 55/10* (2006.01)
*B65B 51/30* (2006.01)
*B65B 9/20* (2012.01)
*B65B 43/10* (2006.01)

(58) Field of Classification Search
CPC ..... B32B 2439/70; A61L 2202/18; A61L 2202/23; A61L 2/186
USPC ..... 53/131.2, 426, 431, 432, 471, 485, 488, 53/489, 510, 511, 545, 562, 281
See application file for complete search history.

(56) References Cited

U.S. PATENT DOCUMENTS 3,904,361 A * 9/1975 Egger ..... 422/27
4,045,939 A * 9/1977 Baumstingl ..... B65B 55/103 422/41
4,606,174 A * 8/1986 Berg ..... B65B 3/04 426/410
4,731,980 A * 3/1988 Worden ..... B29C 53/48 493/302
4,734,268 A * 3/1988 Redding ..... B65B 55/027 422/28
4,809,485 A * 3/1989 Nielsen ..... B65B 39/00 53/503
5,008,076 A * 4/1991 Johansson ..... B65B 55/103 422/28
5,044,140 A * 9/1991 Iwano et al. ..... 53/167
5,114,671 A * 5/1992 Olanders ..... B65B 55/103 34/640
5,173,259 A * 12/1992 Bordini ..... B65B 55/02 422/28
5,546,733 A * 8/1996 Paltrinieri ..... B65B 9/12 141/95
5,672,374 A * 9/1997 McCabe ..... 426/635
6,039,922 A * 3/2000 Swank ..... B65B 55/04 422/24
6,431,434 B1 * 8/2002 Haughton ..... B65B 61/205 220/708
6,666,002 B1 * 12/2003 Otsuka et al. ..... 53/426
6,810,644 B2 * 11/2004 Palm ..... 53/450
7,003,934 B1 * 2/2006 Yano ..... 53/552
7,757,464 B2 * 7/2010 Hirata et al. ..... 53/452
2001/0035500 A1 * 11/2001 Schianchi et al. ..... 250/455.11
2001/0047641 A1 * 12/2001 Kume ..... B65B 9/213 53/493
2001/0053402 A1 * 12/2001 Orii et al. ..... 426/399
2002/0124526 A1 * 9/2002 Lewis, Jr. ..... A61J 1/10 53/396
2002/0134051 A1 * 9/2002 Kurth ..... B65B 55/103 53/425
2003/0177739 A1 * 9/2003 Lewis, Jr. ..... B65B 9/20 53/425
2003/0185948 A1 * 10/2003 Garwood ..... 426/392
2004/0011004 A1 * 1/2004 Kurth ..... 53/426
2004/0086421 A1 * 5/2004 Moller et al. ..... 422/22
2005/0076612 A1 * 4/2005 Andersson et al. ..... 53/167
2005/0126117 A1 * 6/2005 Benedetti et al. ..... 53/167
2009/0282784 A1 * 11/2009 Ferrarini et al. ..... 53/426
2011/0038756 A1 * 2/2011 Donati ..... B65B 55/103 422/28
2011/0099955 A1 * 5/2011 Konno et al. ..... 53/545
2011/0146205 A1 * 6/2011 Caudle et al. ..... 53/410
2011/0154779 A1 * 6/2011 Baba et al. ..... 53/111 R
2011/0185686 A1 * 8/2011 Konno et al. ..... 53/548
2011/0225929 A1 * 9/2011 Donati ..... B29C 65/3656 53/377.7
2014/0199215 A1 * 7/2014 Ghirardello ..... A61L 2/18 422/292
2015/0210417 A1 * 7/2015 Donati ..... B65B 55/103 53/167

FOREIGN PATENT DOCUMENTS

EP 2 143 643 A1 1/2010
JP 48-16778 A 3/1973
JP 2005-516858 A 6/2005
RU 2310589 C2 11/2007

OTHER PUBLICATIONS

Written Opinion (PCT/ISA/237) mailed on Nov. 14, 2012, by the European Patent Office as the International Searching Authority for International Application No. PCT/EP2012/066766.
Office Action issued on Apr. 19, 2016 by the Russian Patent Office in corresponding Russian Patent Application No. 2014117185, and an English language translation of Office Action. (15 pages).

* cited by examiner

PACKAGING MACHINE AND METHOD FOR PRODUCING SEALED PACKAGES OF A FOOD PRODUCT FROM A WEB OF A PACKAGING MATERIAL

TECHNICAL FIELD

The present invention relates to a packaging machine and to a method for producing sealed packages of a food product from a web of packaging material.

BACKGROUND ART

As it is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may be defined by a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which the tube is formed continuously from the web-fed packaging material. More specifically, the web of packaging material is unwound off a reel and fed through a station for applying a sealing strip of heat-seal plastic material, and through an aseptic chamber on the packaging machine, where it is sterilized, e.g. by applying a sterilizing agent such as hydrogen peroxide, which is subsequently evaporated by heating, and/or by subjecting the packaging material to radiation of appropriate wavelength and intensity.

The web of packaging material is then fed through a number of forming assemblies which interact with the packaging material to fold it gradually from strip form into a tube shape.

More specifically, a first portion of the sealing strip is applied to a first longitudinal edge of the packaging material, on the face of the material eventually forming the inside of the packages; and a second portion of the sealing strip projects from the first longitudinal edge.

The forming assemblies are arranged in succession, and comprise respective roller folding members defining a number of packaging material passages varying gradually in cross-section from a C shape to a substantially circular shape.

On interacting with the folding members, the second longitudinal edge is laid on the outside of the first longitudinal edge with respect to the axis of the tube being formed. More specifically, the sealing strip is located entirely inside the tube, and the face of the second longitudinal edge facing the axis of the tube is superimposed partly on the second portion of the sealing strip, and partly on the face of the first longitudinal edge located on the opposite side to the first portion of the sealing strip.

Packaging machines of the above type are known in which the first and second longitudinal edges are heat sealed within the aseptic chamber to form a longitudinal seal along the tube, which is then filled with the sterilized or pasteurized food product.

Furthermore, packaging machines of the above type comprise a forming unit in which the tube and is sealed and cut along equally spaced cross sections to form pillow packs.

Forming unit comprise two or more jaws which cyclically interact with the tube to seal it.

Pillow packs are then folded mechanically to form respective packages at a folding unit, which is arranged downstream from the movable components of the forming unit.

In detail, the forming unit is arranged downstream from the aseptic chamber, with reference to the advancing direction of the tube.

Furthermore, a seal separates in a tight-fluid way the aseptic chamber from the forming unit, by exerting a pressure against the tube of packaging material.

However, some residues of peroxide inevitably pass through the seal, especially when the web of packaging material is provided with a plurality of closable opening devices which are applied by injecting plastic material directly onto the web.

As a matter of fact, the opening devices advancing with the tube move away the seal from the outer diameter of the tube, so reducing the effectiveness of the seal in tight-fluid separating the aseptic chamber.

This situation is exacerbated by the fact that the high speed at which the tube is fed renders the lapse of time between the passages of two subsequent opening devices against the seal very short. Accordingly, the lapse of time during which the seal effectively presses against the tube is reduced.

The peroxide residues may penalize the wear resistance of mechanical components of the forming and folding units, for example the jaws.

Accordingly, a need is felt within the industry to reduce as far as possible the amount of peroxide which may pass through the seal and possibly contact the forming unit or other downstream components of the packaging machines.

Furthermore, the forming unit is normally accessible by a human operator.

European regulations require that peroxide residues in the air be under a certain threshold at the stations of the packaging machine which are accessible from the human operator, for example the forming and folding units.

A need is felt, therefore, to reduce as far as possible the peroxide concentrations in those stations of the packaging machines which are accessible by the human operator and are arranged downstream from the seal.

DISCLOSURE OF INVENTION

It is therefore an object of the present invention to provide a packaging machine for producing sealed packages of pourable food products from a web of packaging material, designed to meet at least one of the above-identified need in a straightforward manner.

This object is achieved by a packaging machine for producing sealed packages of pourable food products from a web of packaging material, comprising an aseptic chamber through which the web is fed and within which a sterilizing agent is applied onto the web, a station arranged downstream from the aseptic chamber and in which a tube formed by the web is, in use, fed, and sealing means which separate the chamber and the station, the packaging machine being characterized by comprising conveying means fluidically connected with the station and adapted to convey away residues of the sterilizing agent from the station.

The present invention also relates to a method of producing sealed packages of a food product from a web of packaging material, comprising feeding the web through an aseptic chamber of a packaging machine, applying a sterilizing agent onto the web within the aseptic chamber, feeding a tube formed by the web within a station of the packaging machine, and interposing sealing means between the aseptic chamber and the first station, the method being characterized by comprising the step of conveying away residues of the sterilizing agent from the station.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
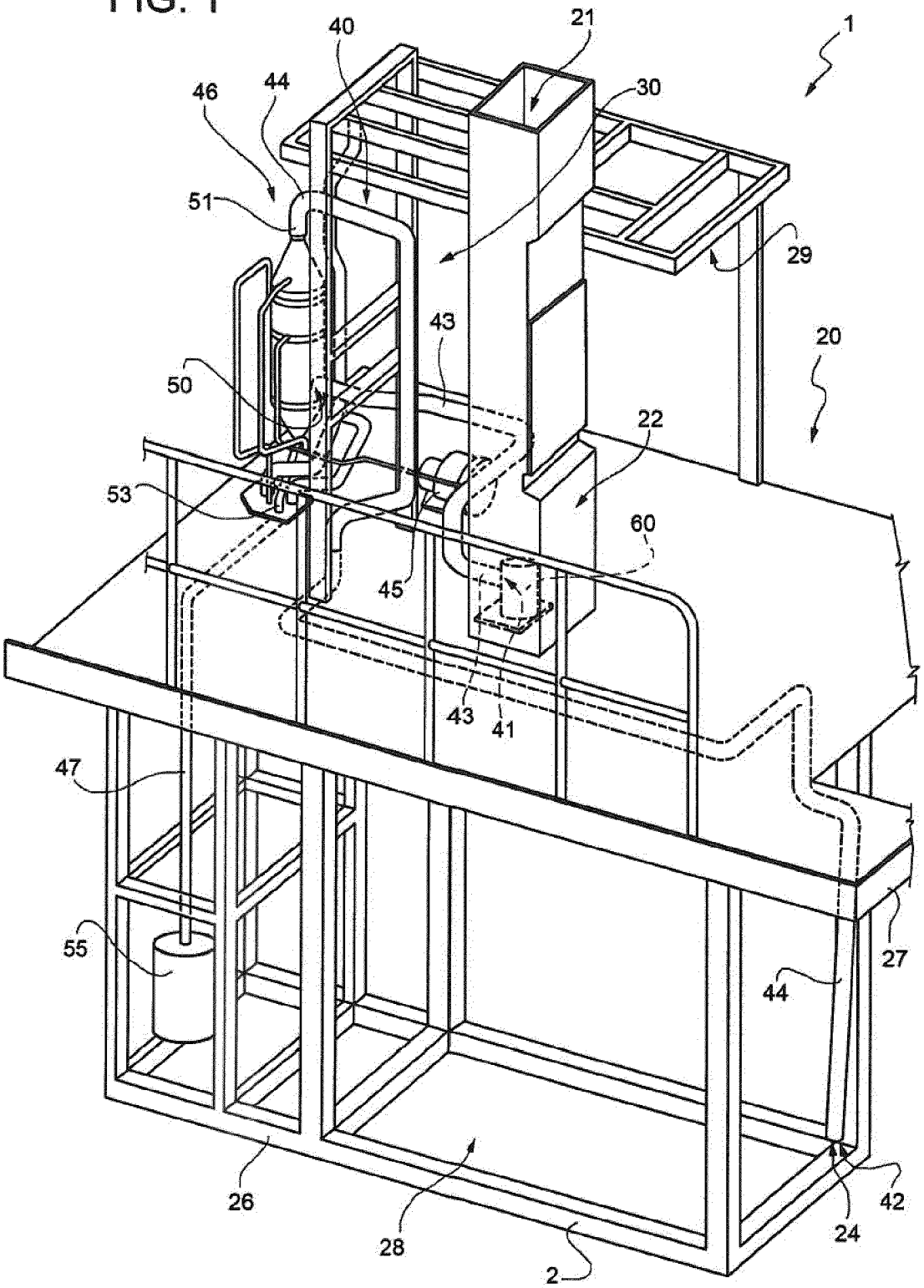
FIG. 1 is a perspective view of the packaging machine, in accordance with the present invention.
Figure 2:
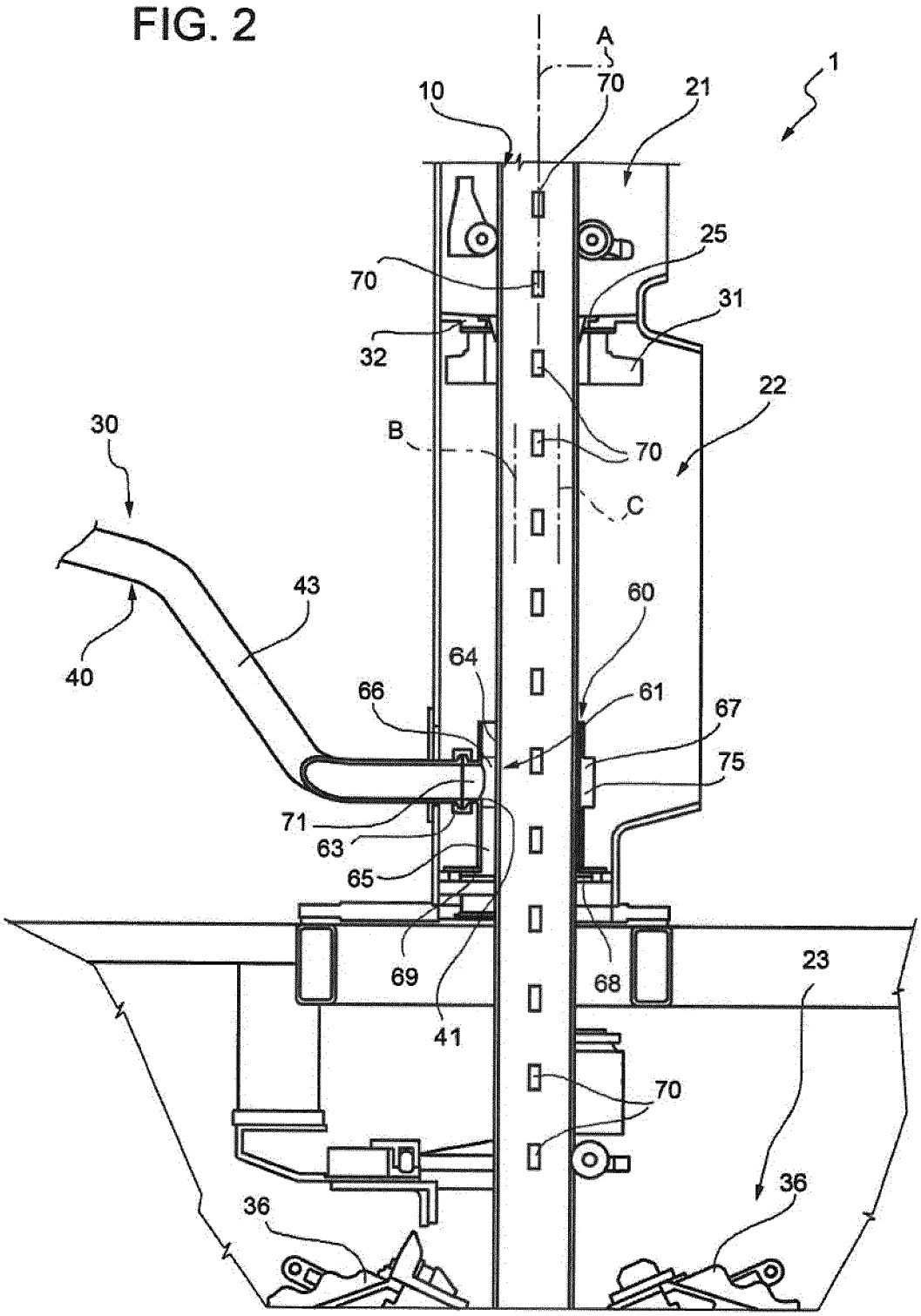
FIG. 2 is an enlarged front view of some components of the packaging machine of FIG. 1, with parts removed for clarity.
Figure 3:
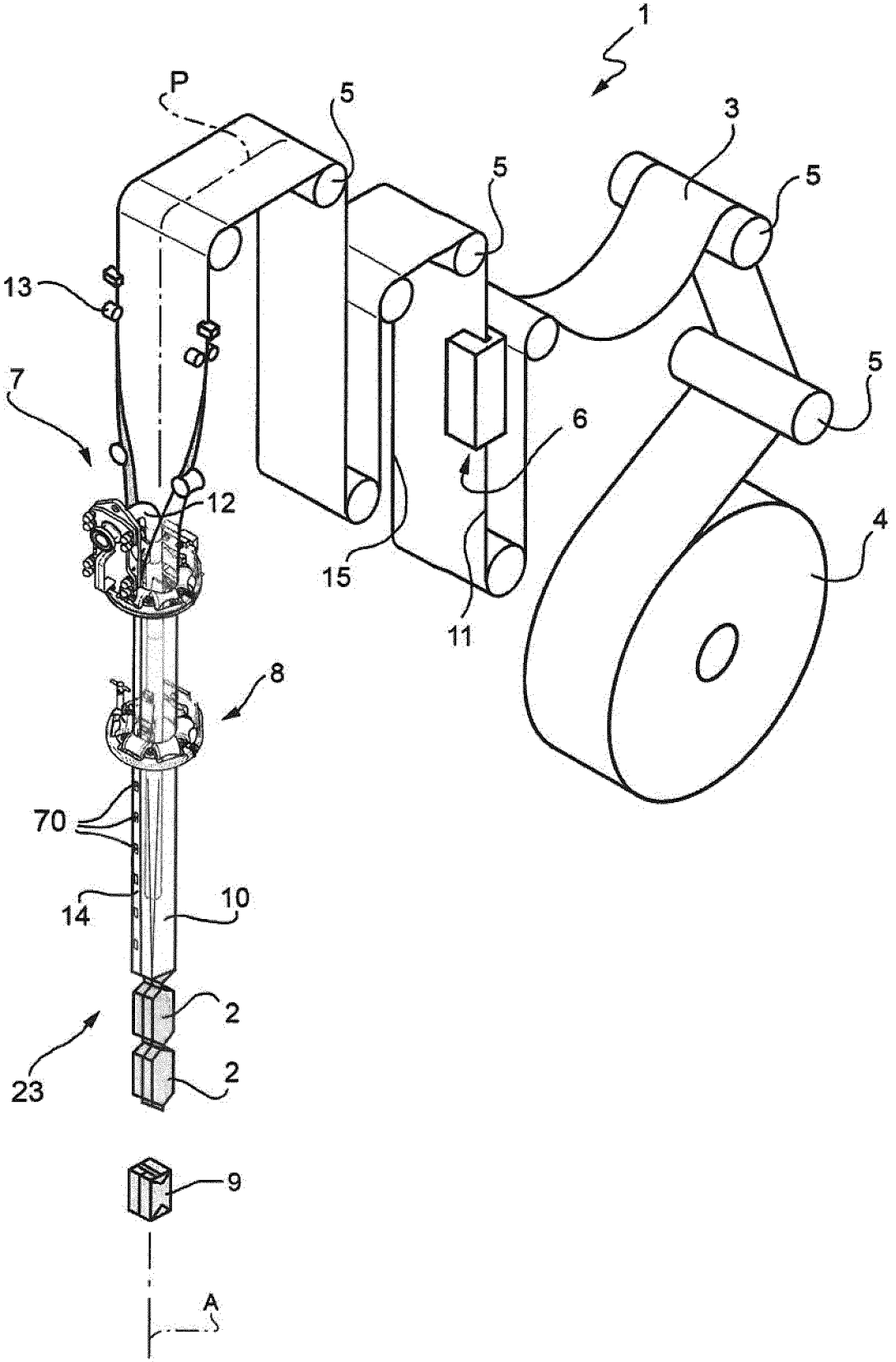
FIG. 3 shows further components of the packaging machine of FIG. 1, with parts removed for clarity.

Number 1 in FIGS. 1 to 3 indicates as a whole a packaging machine for continuously producing sealed packages 9 of a food product from a web 3 of packaging material, which is unwound off a reel 4 and fed along a forming path P.

Machine 1 preferably produces sealed packages 9 of a pourable food product, such as pasteurized or UHT milk, fruit juice, wine, peas, beans, etc.

Machine 1 may also produce sealed packages 9 of a food product that is pourable when producing packages 9, and sets after packages 9 are sealed. One example of such a food product is a portion of cheese, that is melted when producing packages 9, and sets after packages 9 are sealed.

The packaging material has a multilayer structure substantially comprising a base layer for stiffness and strength, which may be defined by a layer of fibrous material, e.g. paper, or mineral-filled polypropylene material; and a number of layers of heat-seal plastic material, e.g. polyethylene film, covering both sides of the base layer.

More specifically, as shown in FIG. 3, web 3 is fed along path P by guide members 5, e.g. rollers or similar, and successively through a number of work stations, of which are shown schematically: a station 6 for applying a sealing strip to web 3; a forming station 7 for forming a tube 10 of packaging material having an axis A; and a station 8 for heat sealing a longitudinal seal 14 along tube 10.

In one preferred embodiment, web 3 comprises a plurality of directly injection-molded closable opening devices 70.

Machine 1 also comprises a fill device 12 for pouring the sterilized or sterile-processed food product continuously into tube 10 of packaging material.

Very briefly, the sealing strip prevents edge 11 from absorbing the food product once tube 10 and seal 14 of the tube are formed, and also provides for improving the gas-barrier performance and physical strength of seal 14.

Station 7 comprises a number of forming assemblies arranged successively along path P, and which interact gradually with web 3 to fold it into the form of tube 10.

More specifically, forming assemblies 13 comprise respective numbers of rollers defining respective compulsory packaging material passages, the respective sections of which vary gradually from a C shape to a substantially circular shape.

More specifically, machine 1 comprises (FIG. 1) a frame 20 which substantially comprises:

- a base 26 supported by the ground;
- a platform 27 parallel to base 26;
- a top compartment 29 arranged above platform 27; and
- a bottom compartment 28 arranged between base 26 and platform 27 and accessible by the human operator.

Compartment 29 houses:

- an aseptic chamber 21 where web 3 is sterilized and tube 10 is formed by web 3; and
- a station 22 through which tube 10 is fed.

Compartment 28 houses a forming and folding unit 23 (also referred to as a second station) where tube 10 is sealed and cut to form pillow packs 2 which are subsequently folded to form respective packages 9, a bottom area 24, and a not-shown folding station where packs 2 are folded, so as to form respective finished packages 9.

Web 3 is sterilized within aseptic chamber 21 by using a sterilizing agent, hydrogen peroxide in the embodiment shown, which is subsequently evaporated by heating, and/or by subjecting the packaging material to radiation of appropriate wavelength and intensity.

Stations 6, 7, 8 are housed within chamber 21.

Machine 1 also comprises a seal 25 (e.g., member) interposed between chamber 21 and station 22 and adapted to prevent the sterilizing agent from flowing towards station 22, forming and folding unit 23 and area 24 (FIG. 2).

Seal 25 is coaxial with tube 10 and the inner diameter of seal 25 contacts the outer diameter of tube 10.

As shown in FIG. 2, seal 25 is interposed between a flange 31 and a fixed structure 32 which defines the bottom end of aseptic chamber 21.

Forming and folding unit 23 is adapted to:

- firstly, grip, seal and cut tube 10 along equally spaced cross section to form a succession of packs 2; and
- then, fold packs 2 to form respective packages 9.

Forming and folding unit 23 is shown only in the part regarding a pair of jaws 36 which are cyclically movable between:

- an open position in which they are detached from tube 10; and
- a close position in which they grip tube 10 and heat seal it along a cross section thereof.

Frame 20 comprises a plurality of windows (not-shown) which render forming and folding unit 23 and folding unit accessible by a human operator.

Advantageously, machine 1 comprises conveying means 30 fluidically connected with station 22 and adapted to convey away residues from sterilizing agent from station 22 (FIG. 2).

More precisely, conveying means 30 substantially comprise:

- a fluidic circuit 40 having an inlet end 41 fluidically connected to station 22 and an outlet end 42, opposite to end 41, which is fluidically connected to bottom area 24;
- a pump 45 interposed along circuit 40 and adapted to pump away air together with residues of sterilizing agent from station 22; and a separating element 46 interposed along conduit 40.

In detail, circuit 40 receives air with sterilizing agent at inlet end 41 and outputs cleaned air at outlet end 42.

Circuit 40, in particular, comprises:

a conduit 43 defining end 41 and extending between end 41 and separating element 46; and a conduit 44 defining end 42, along which pump is interposed, and extending between separating element 46 and end 42.

Pump 45 is interposed along circuit 40 between separating element 46 and end 42, and separating element 46 is interposed along circuit 40 between end 41 and pump 45.

Separating element 46 is, in the embodiment shown, a scrubber.

More precisely, separating element 46 cleans the mixture of air and sterilizing agent via the contact of the mixture with a scrubbing solution.

Very briefly, separating element 46 ejects the scrubbing solution in a first direction whereas the mixture of air and sterilizing agent advances in a second direction, opposite to the first direction.

In detail, separating element 46 comprises:

an inlet end 50 at which it receives the mixture of air and sterilizing agent by circuit 40, via conduit 43;

an outlet end 51 at which it outputs the cleaned air; and an outlet end 53 at which it discharges the scrubbing solution together with the residues of the sterilizing agent.

The cleaned air advances in the second direction (directed from end 50 to end 51), when it passes through end 51.

The residues of sterilizing agent are advanced by the scrubbing solution in the first direction (directed from end 51 to end 50), when they pass through end 53.

End 53 of separating element is fluidically connected via a conduit 47 with a tank 55.

Tank 55 is arranged within compartment 28.

In the embodiment shown, the scrubbing solution is water.

Preferably, the scrubbing solution is water at a temperature which is lower than the temperature of the mixture of air and oxygen peroxide. In this way, the solubility of oxygen peroxide within water is increased.

Station 22 also comprises a hollow hood 60 through which a portion 61 of tube 10 passes (FIG. 2).

In detail, hood 60 surrounds portion 61 of tube 10 and comprises:

a hollow top body 64;

a hollow bottom body 65; and a hollow intermediate body 66 axially interposed between bodies 64, 65.

Bodies 64, 65 are cylindrical and extend about an axis B parallel to and distinct from axis A.

Body 66 comprises:

a connector 71 which is connected to end 41 of conduit 43 by using a clamp 63; and a cylindrical element 67 which extends about an axis C parallel to and distinct from axis A, B.

In other words, element 67 is eccentric relative to bodies 64, 65, which are, in turn, eccentric relative to tube 10.

More precisely, axis A is interposed between axes B, C. Furthermore, axis B is radially interposed between axes A, C.

Furthermore, axis C is arranged on the opposite side of conduit 43 relative to axis A.

As a result, element 66 radially protrudes from bodies 64, 65 on the opposite side of conduit 43, so as to define a compartment 75 with the side of tube 10 opposite to conduit 43.

Furthermore, axis A is closer to lateral surfaces of bodies 64, 65 on the side of compartment 75 than on the side of conduit 43.

Body 65 is supported, on the opposite side of element 66, by an annular element 69 which, in turn, rests on a rubber ring 68.

Body 65 is also welded to element 69.

In actual use, web 3 is unwound off reel 4 and fed along path P.

More specifically, web 3 is fed by guide members 5 along path P and through aseptic chamber 21.

Web 3 is sterilized within aseptic chamber 21 by using a sterilizing agent, hydrogen peroxide in the embodiment shown.

The sterilizing agent is subsequently evaporated by heating, and/or by subjecting the packaging material to radiation of appropriate wavelength and intensity.

As shown in FIG. 3, web 3 passes through successive stations 6, 7, 8, within which seal 14 is formed and strip is applied onto packaging material.

Web 3 interacts gradually with forming assemblies 13, and is folded to superimpose edges 11, 15 and form tube 10 not yet sealed longitudinally.

At station 8, edge 15 is heated to melt the polyethylene layer, and heat is transmitted, for example, by conduction from edge 15 to edge 11 and the sealing strip to melt the polyethylene layer of edge 11 and the heat-seal material of strip 9.

Alternatively, other heat transmitting means may be used for heating edge 11 and the sealing strip.

Next, edges 11, 15 and strip are compressed between rollers to blend the polyethylene layer of edges 11, 15 and the heat-seal material of strip, and so form the molecular bonds defining seal 14 of the finished tube 10.

The longitudinally sealed tube 10 is filled continuously with the pourable food product by device 12, and is then fed through station 22.

At this stage, the longitudinal sealed tube 10 passes through seal 25 and enters station 22.

A certain amount of residues of peroxide could pass through seal 25 together with tube 10.

The passage of directly injected molded opening devices 70 through seal 25 detaches the inner diameter of seal 25 from the outer diameter of tube 10, thus increasing the amount of sterilizing agent that reaches station 22.

Conveying means 30 convey air together with residues of sterilizing agent away from station 22.

More in detail, the air and the residues are pumped away by pump 45 from hood 60 and station 22, and pass through end 41 and conduit 43.

Furthermore, due to the presence of compartment 75, residues are substantially prevented from remaining trapped within the side of hood 60 which is opposite to conduit 43.

Afterwards, the mixture of air and the residues reaches separating element 46. Here, the scrubbing solution is ejected on the mixture.

As a result, the scrubbing solution and the residues of peroxide are conveyed to tank 55 through conduit 47.

Furthermore, the cleaned air is conveyed, through conduit 44 to bottom area 24.

Tube 10 is then conveyed to the folding and forming unit 23 where it is gripped, sealed, and cut along equally spaced cross sections to form a succession of packs 2, which are subsequently folded so as to form respective packages 9.

The advantages of machine 1 and of the method according to the present invention will be clear from the foregoing description.

In particular, conveying means 30 dramatically reduce the amount of sterilizing agent that reaches the forming unit 22.

In this way, the risk that the sterilizing agent can reduce the wear resistance of the mechanical components, like jaws 36, of the forming and folding unit 23 is dramatically reduced.

Furthermore, when accessing forming and folding unit 23, the human operator is subjected to very reduced values of sterilizing agent, so minimizing the dangers for his health.

More precisely, the Applicant has found that conveying means 30 allow machine 1 to fulfill the European requirements for the peroxide level at those are that are accessible by the human operator, as forming unit and folding unit 23.

In detail, the Applicant has found that the air at forming and folding unit 23 close to jaws 36 contains less than 0.4 ppm of hydrogen peroxide.

Furthermore, the cleaned air is conveyed to area 24, i.e. to a zone of machine 1 which is not directly accessible by the human operator.

Also in this case, the Applicant has found that the cleaned air conveyed to area 24 fulfills the European regulation. In detail, the Applicant has found that the cleaned air conveyed to area 24 contains less than 1 ppm of hydrogen peroxide.

The Applicant has also found that the air conveyed by conveying means 30 to area 24 contains 0.3 ppm after 1 hour from the starting of the operation of machine 1; 0.4 ppm after 2 hour from the starting of the operation of machine 1; 0.5 ppm after 3 or 4 hours from the starting of the operation of machine 1.

The Applicant has also found that, at the folding components of the folding and forming unit 23, the air contains 0.5 ppm of hydrogen peroxide.

Finally, hood 60 allows conveying means 30 to pump away from station 22 also the residues of sterilizing agent which have already reached the forming and folding unit 23.

In other words, hood 60 creates a current of air and residues, which moves upwardly from the forming and folding unit 23 towards conveying means 30.

Compartment 75 creates a room which is effective in preventing residues of sterilizing agent from being trapped between hood 60 and tube 10.

Clearly, changes may be made to machine 1 and to the method as described and illustrated herein without, however, departing from the scope defined in the accompanying Claims.

In particular, hood 60 could taper towards aseptic chamber 21.

The invention claimed is:

1. A packaging machine for producing sealed packages of pourable food products from a web of packaging material, comprising:

an aseptic chamber through which the web of packaging material is fed in a feeding direction, the aseptic chamber within which a sterilizing agent is applied onto the web of packaging material and within which the web is formed into a tube;

a station arranged downstream from the aseptic chamber in the feeding direction and in which the tube is fed;

a member positioned between the chamber and the station, the member possessing an inner surface configured to contact an outer surface of the tube as the tube is fed in the feeding direction from the aseptic chamber, through the member, and to the station to prevent the sterilizing agent in the aseptic chamber from flowing toward the station;

a fluid circuit including an inlet end which opens into the station at a position downstream of the member in the feeding direction, the fluid circuit being fluidically connected with the station to convey away residues of the sterilizing agent located downstream of the member relative to the feeding direction by passing through the inlet end, the fluid circuit being fluidically interposed between the station and an area of the packaging machine, and the fluid circuit receiving air current with the residues by the station and feeding a current of cleaned air to the area;

a separating element interposed along the fluid circuit and configured to separate the residues from the air current; and a plurality of closable opening devices spaced apart along the tube and projecting from the outer surface of the tube, each of the opening devices possessing an outer surface.

2. The packaging machine of claim 1, wherein said separating element comprises a source of a scrubbing fluid and means for ejecting said scrubbing fluid onto said current of air containing said residues.

3. The packaging machine of claim 1, further comprising pumping means interposed along said fluid circuit for pumping away a current of air containing said residues from said station.

4. The packaging machine of claim 1, comprising a tank fluidically connected with said separating element and fed by said separating element with a mixture containing said residues.

5. The packaging machine of claim 1, comprising a hood fluidically connected with said fluid circuit, arranged within said station and surrounding at least one part of said tube.

6. The packaging machine of claim 5, wherein said hood comprises at least one first body and a compartment radially protruding from said first body on an opposite side of said fluid circuit.

7. The packaging machine of claim 6, wherein the at least one first body possesses a longitudinal axis constituting a first axis, and the tube possesses a longitudinal axis constituting a second axis, wherein said first axis is parallel to and distinct from the second axis;

said hood further comprising a second body fluidically connected to said fluid circuit and defining said compartment, the second body possessing a longitudinal axis constituting a third axis; and said third axis being parallel to and distinct from both said first and second axes.

8. The packaging machine of claim 1, comprising a forming and folding unit for forming a plurality of packs from said tube and for folding said packs to form respective packages;

said forming and folding unit being accessible from a human operator, and being arranged downstream from said station, with reference to the advancing sense of said packaging material;

said forming and folding unit being arranged above said area.

9. A method for producing sealed packages of pourable food products from a web of packaging material, the method comprising:

feeding said web through an aseptic chamber of a packaging machine in a feeding direction, the packaging machine also including a station and a member located between the aseptic chamber and the station, the member possessing an inner surface, the web including a plurality of closable opening devices spaced apart along the web;

applying a sterilizing agent onto the web within the aseptic chamber;

forming the web into a tube of packaging material in the aseptic chamber and feeding the tube of packaging material out of the aseptic chamber in the feeding direction, the tube of packaging material possessing an outer surface, the plurality of closable opening devices being spaced apart along the tube and projecting from the outer surface of the tube, each of the opening devices possessing an outer surface;

feeding the tube of packaging material in the feeding direction to the station of the packaging machine such that the tube of packaging material passes through the member while the outer surface of the tube of packaging material contacts the inner surface of the member as the tube of packaging material is fed from the aseptic chamber to the station, the contact of the outer surface of the tube of packaging material with the inner surface of the member preventing the sterilizing agent in the aseptic chamber from flowing toward the station;

conveying away residues of the sterilizing agent located downstream of the member relative to the feeding direction by passing the residues through an inlet end of a fluid circuit, the inlet end opening into the station at a location downstream of the member relative to the feeding direction; and wherein the conveying away of the residues of the sterilizing agent comprises feeding the fluid circuit with an air current together with the residues, separating the air current from the residues, and feeding an area of the packaging machine with a current of cleaned air.

10. The method of claim 9, wherein the separating of the air current from the residues comprises ejecting a scrubbing solution onto the air current containing the residues.

11. The method of claim 10, wherein the ejecting of the scrubbing solution comprises ejecting scrubbing solution at a lower temperature than the temperature of the air current.

* * * * *